US009892837B2

(12) United States Patent
Rokosz et al.

(10) Patent No.: US 9,892,837 B2
(45) Date of Patent: Feb. 13, 2018

(54) ENERGY EFFICIENT ACTUATOR

(71) Applicants: John A Rokosz, Belmont, MA (US); Philip Carvey, Bedford, MA (US); Nicholas Howard, Bedford, MA (US); Wallace Atwood, Gloucester, MA (US); Ryan Rank, Ann Arbor, MI (US)

(72) Inventors: John A Rokosz, Belmont, MA (US); Philip Carvey, Bedford, MA (US); Nicholas Howard, Bedford, MA (US); Wallace Atwood, Gloucester, MA (US); Ryan Rank, Ann Arbor, MI (US)

(73) Assignee: ADICEP TECHNOLOGIES, INC, Bedford, MA (US)

( * ) Notice: Subject to any disclaimer, the term of this patent is extended or adjusted under 35 U.S.C. 154(b) by 0 days.

(21) Appl. No.: 14/718,233

(22) Filed: May 21, 2015

(65) Prior Publication Data

US 2016/0343495 A1 Nov. 24, 2016

(51) Int. Cl.

| | |
|---|---|
| ***H01F 7/00*** | (2006.01) |
| ***H01F 7/08*** | (2006.01) |
| ***H01F 7/16*** | (2006.01) |

(52) U.S. Cl.

CPC ..... *H01F 7/081* (2013.01); *H01F 7/1646* (2013.01)

(58) Field of Classification Search

CPC ..... H01F 7/14; H02K 41/033
USPC ..... 335/229, 87; 310/12.01, 35, 36
See application file for complete search history.

(56) References Cited

U.S. PATENT DOCUMENTS

| | | | | | |
|---|---|---|---|---|---|
| 4,059,775 | A | * | 11/1977 | Warmka | H01F 7/14 310/12.08 |
| 4,287,457 | A | * | 9/1981 | Takemura | H02K 33/16 310/36 |
| 4,314,295 | A | * | 2/1982 | Frandsen | H02K 41/03 310/13 |
| 4,870,335 | A | * | 9/1989 | Koshida | B65H 29/60 310/27 |
| 5,038,062 | A | * | 8/1991 | Shiraki | H02K 41/02 310/36 |
| 5,041,935 | A | * | 8/1991 | Aruga | H01F 7/145 360/264.9 |
| 5,185,542 | A | | 2/1993 | Lazorchak | |
| 5,196,745 | A | * | 3/1993 | Trumper | F16C 29/00 310/12.06 |
| 5,587,852 | A | * | 12/1996 | Yoshiura | G11B 5/553 310/12.08 |

(Continued)

FOREIGN PATENT DOCUMENTS

| | | |
|---|---|---|
| EP | 0438830 A2 | 7/1991 |
| GB | 2142780 A | 1/1985 |
| JP | A-2007-288828 | 1/2007 |

OTHER PUBLICATIONS

Nogueira, Journal of Microwaves, Optoelectronics and Electromagnetic Applications, vol. 10, No. 1, Jun. 2011.

(Continued)

*Primary Examiner* — Alexander Talpalatski
(74) *Attorney, Agent, or Firm* — The Patent Practice of Szmanda & Shelnut, LLC; Charles R. Szmanda; James G. Shelnut

(57) ABSTRACT

Disclosed herein is an actuator wherein, when in use, a magnetic force holding assembly maintains the slider in substantial repulsion at the first position and substantial attraction at the second position.

22 Claims, 11 Drawing Sheets

(56) References Cited

U.S. PATENT DOCUMENTS 5,703,417 A * 12/1997 Kelly ..... H02K 41/031 310/12.21
5,739,605 A 4/1998 Lazorchak
6,037,680 A * 3/2000 Korenaga ..... G03F 7/70358 310/12.22
6,107,703 A * 8/2000 Korenaga ..... G03F 7/70691 310/12.06
6,501,357 B2 12/2002 Petro
6,507,257 B2 * 1/2003 Mohler ..... H02K 26/00 310/36
6,590,355 B1 * 7/2003 Kikuchi ..... G03F 7/70716 310/12.06
6,717,294 B2 * 4/2004 Chuo ..... H02K 41/03 310/12.06
7,468,646 B2 * 12/2008 Osterberg ..... G02B 26/00 335/179
7,652,549 B2 * 1/2010 Hadden ..... H02K 1/24 310/156.01
7,683,749 B2 * 3/2010 Yajima ..... H02K 41/0356 335/222
7,859,144 B1 * 12/2010 Sahyoun ..... H02K 33/16 310/14
8,193,883 B2 * 6/2012 Long ..... G02B 7/005 335/179
8,421,564 B2 * 4/2013 Yajima ..... H01F 7/1646 310/12.25
8,569,916 B2 * 10/2013 Sugita ..... H02K 33/16 310/12.15
8,702,133 B2 4/2014 Sun et al.
8,771,210 B2 7/2014 Smith et al.
9,473,007 B2 * 10/2016 Kirihara ..... H02K 33/16
2005/0029819 A1 * 2/2005 Osterberg ..... G02B 7/005 292/251.5
2008/0123348 A1 * 5/2008 Chang ..... H01F 7/066 362/321
2010/0263981 A1 10/2010 Krafft et al.
2012/0007451 A1 * 1/2012 Nelson ..... H02K 26/00 310/36
2013/0220763 A1 8/2013 Hyde et al.
2014/0230584 A1 8/2014 Hudson et al.
2014/0239747 A1 8/2014 Takahashi

OTHER PUBLICATIONS

Goldshine and Lacy, High-Response Electromechanical Control Actuator 3rd Aerospace Mechanisms Symposium Jet Propulsion Laboratory May 23-24, 1968.
Petrescu, and Olaru, Advances in Electrical and Computer Engineering vol. 9, No. 3, 2009.
Masayuki Kurita et al., "Active Flying-height Control of Magnetic Head Sl ider Slider using MEMs Thermal Actuator" No known date. Appears to have been derived from Japanese Reference Kurita et al., Transactions of the Japan Society of Mechanical Engineers Series C vol. 72 (2006) No. 713 p. 267-273.

* cited by examiner 520
506
509
510
511
512
513
508
507

S
N
N
S
509
541
540

520
506
549
552
502
505
504
503
507
508

N
S

S
N
549
551
550

608
607
613
612
609
611
610
606
620

613
612
S
N
N
S
640
609
611
610

608
607
602
649
652
605
604
603
606
620

S
N
650
649

ENERGY EFFICIENT ACTUATOR

STATEMENT OF GOVERNMENT SUPPORT

The subject matter of the present application was made with Government support from the National Science Foundation under contract number IIP-1152605. The Government may have rights to the subject matter of the present application.

FIELD OF THE INVENTION

The present application for patent is in the field of actuators and more specifically is in the field of actuators for mechanical or electromechanical devices such as, but not limited to orthotic devices.

BACKGROUND

In general, mechanical or electromechanical actuators are used to apply a stimulus to a device in order to switch its function between or among functional states. The required actuation may depend on the characteristics of the device being switched. For example, a device may be able to hold its state without further assistance from the actuator. In another example, the device may require actuator assistance to hold its state. Actuators may simply make electrical connections or they may apply a required mechanical force. The latter actuators may work using any phenomenon that generates or transmits a force; wherein the force can be applied actively or passively. Such forces include hydraulic, pneumatic, electric, electrostatic, electromagnetic, thermal, such as might be encountered in materials having shape memory, and mechanical forces. Such forces may be converted into motion.

Actuators may provide unstable states of operation that require the supply of energy to hold one state or another in actuation. However, in applications where it is desirable to conserve energy, such as in devices that use batteries, it is often desirable to for an actuator to provide one or more stable states. In such actuators, little or no energy input is required to hold a state in, for example, "engaged" or "disengaged" positions. Moreover, actuators may have more than two states of operation when, for example, they are used to switch among different states of a device.

In certain circumstances it may be desirable for an actuator to switch between or among states using minimal energy, hold its state without further expenditure of energy, and apply mechanical forces characteristic of each state to the device being actuated. For example, such a device may be desirable for actuating a clutch with a high mechanical advantage.

Various attempts have been made to provide such an actuator. For example, U.S. Pat. No. 8,702,133 to Sun et al provides an actuator for an electronic door lock that includes "a stationary first magnet assembly, a beam, and a second magnet assembly," wherein the first magnet "includes at least one magnet stationarily positioned within the electronic door lock. The beam is movable relative to the first magnet assembly to a first position and a second position. The second magnet assembly is connected to the beam and is configured to be magnetically repulsed away from the first magnet assembly. The repulsion of the second magnet assembly maintains the beam in either the first or second position until the beam is selectively actuated therefrom." However, in this configuration, the forces applied in each of the two states are symmetrical such that the magnet on the movable beam is "magnetically repulsed" about equally in both states of actuation. Many devices to be actuated, such as, for example, clutches with high mechanical advantage, require a "pull" in one state and a "push" in the other state, without drawing power from a power source when in either state. Therefore, there remains a need for actuators having the characteristics hereinabove described. The present application for patent discloses an actuator that addresses these needs.

BRIEF DESCRIPTION OF THE DRAWINGS

FIG. 4(*a*) illustrates a slider, as in FIGS. 1 and 2 with portions of the actuator removed to show the configuration of the magnetic holder. FIG. 4(*b*) illustrates a slider, as in FIGS. 1 and 2 with portions of the actuator removed to show the configuration of the magnetic holder. FIG. 4(*c*) shows an example of the arrangement of the holder magnets with a single static magnet. FIG. 4(*d*) shows an example of the arrangement of the holder magnets with two static magnets. In FIGS. 4(*a*) and 4(*b*), the slider is shown in its left-most stable position.

FIG. 5(*a*) illustrates a slider, as in FIG. 4(*a*) with portions of the actuator removed to show the configuration of the magnetic holder. FIG. 5(*b*) illustrates a slider, as in FIG. 4(*b*) with portions of the actuator removed to show the configuration of the magnetic holder. FIG. 5(*c*) shows an example of the arrangement of the holder magnets with a single static magnet. FIG. 5(*d*) shows an example of the arrangement of the holder magnets with two static magnets. In FIGS. 5(*a*) and 5(*b*), the slider is shown in its midrange position.

FIG. 6(*a*) illustrates a slider, as in FIG. 4(*a*) with portions of the actuator removed to show the configuration of the magnetic holder. FIG. 6(*b*) illustrates a slider, as in FIG. 4(*b*) with portions of the actuator removed to show the configuration of the magnetic holder. FIG. 6(*c*) shows an example of the arrangement of the holder magnets with a single static magnet. FIG. 6(*d*) shows an example of the arrangement of the holder magnets with two static magnets. In FIGS. 6(*a*) and 6(*b*), the slider is shown in its right-most stable position.

DETAILED DESCRIPTION OF THE DRAWINGS

Figure 1:
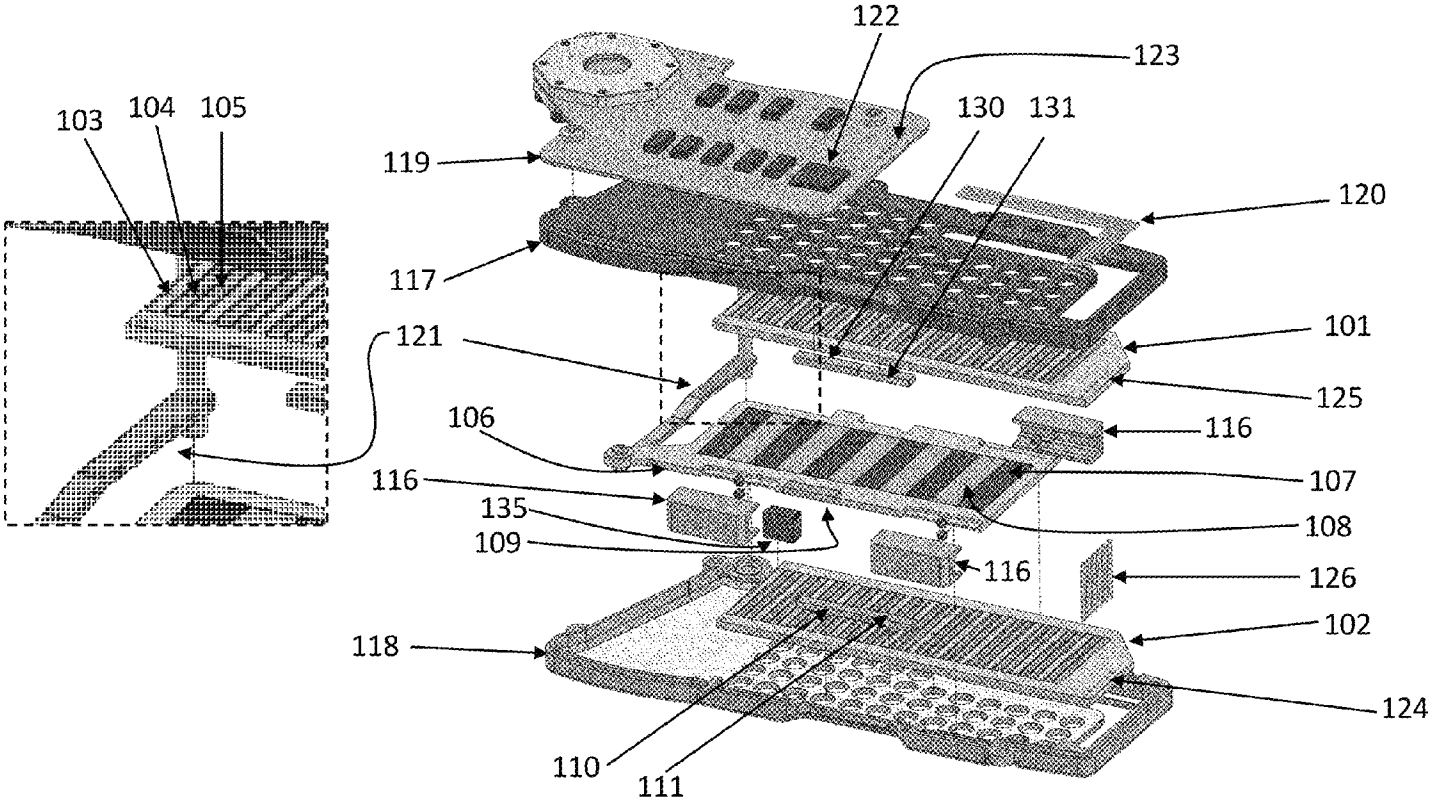
FIG. 1 illustrates an "exploded view" embodiment of an actuator having a linear range of motion.

FIG. 1 illustrates an "exploded view" embodiment of an actuator having a linear range of motion. Shown are two coil subassemblies, each having a substantially flat facing side, each having a frame on which the coils are mounted, 101 and 102. Conducting pathways 103-105, indicated, for example, on the top coil subassembly (shown in the inset), are configured or wired for three-phase operation and are similar to the conducting pathways in the bottom coil subassembly (not numbered). Shading does not indicate instantaneous electromagnetic polarity or current. Rather, shadings of 103-105 indicate how the conducting pathways are arranged when configured for multiphase operation. The slider of FIG. 1, 106 has a plurality of drive magnets, exemplified by 107 and 108, polarized along a vertical direction, with the vertical direction configured so that the pole faces are the flat top and bottom, and arranged with alternately opposite pole faces, wherein the pole faces face the conducting pathways on the coil subassemblies. In this illustration, the magnetic holder assembly comprises stationary magnets, exemplified by 110-111, and 130-131, and a magnet on the slider 109, which may be either attracted or repelled by the stationary magnets. The mounting hardware 117, 118 or the coil subassembly frame may include bearing assemblies 116, comprising ball bearings and slots as guides. A linkage arm, 121, couples the slider 106, to the device being actuated. A platform 119 for electronic control circuitry exemplified by 122 is shown configured to be connected at 123 to the coil subassemblies 101 and 102 via a series of conductors, illustrated by 120, mating connectors 126 and via holes, exemplified by 124, 125. A limiter or "stop" exemplified by 135, may be used to limit the range of motion of the slider.

Figure 2:
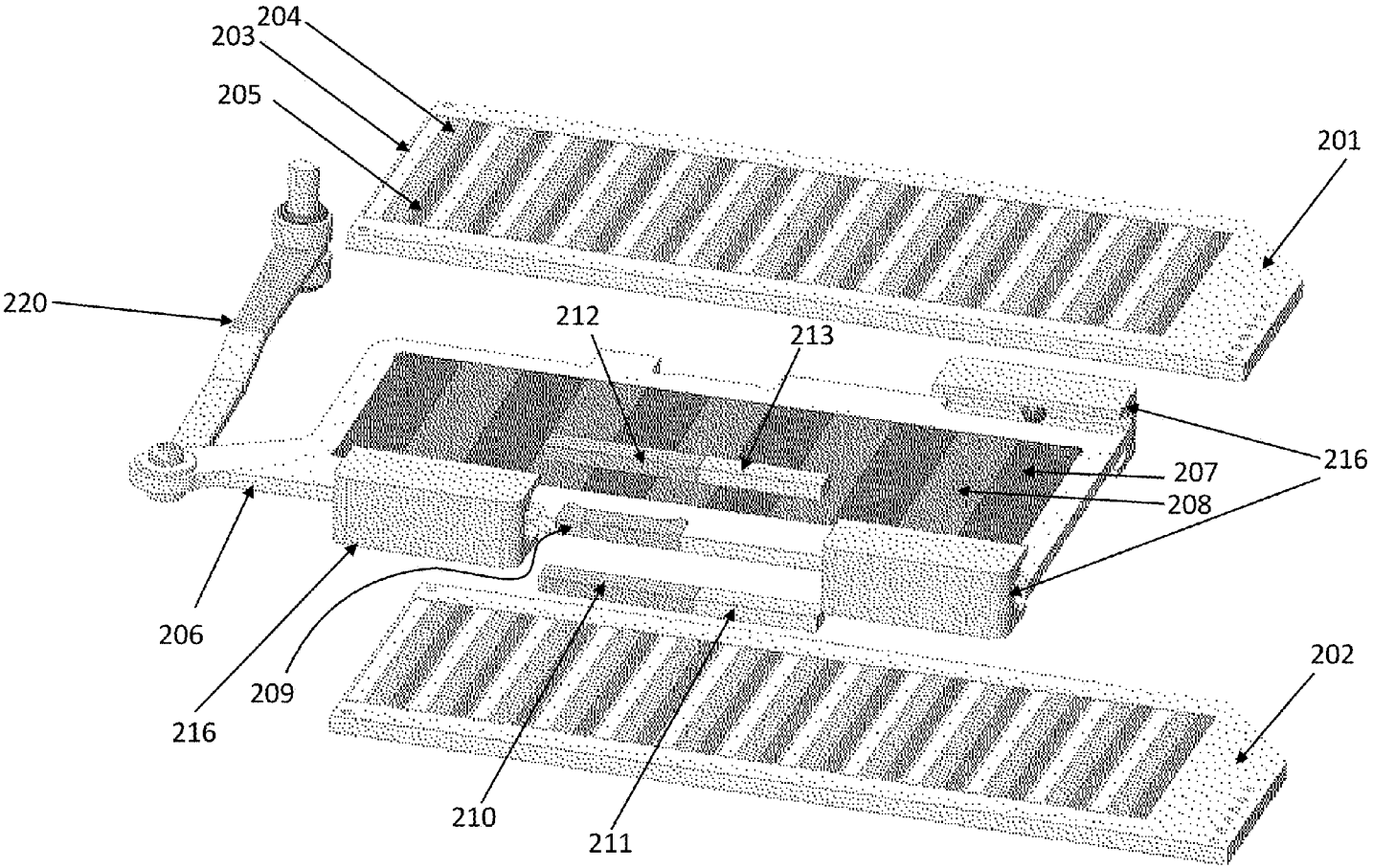
FIG. 2 illustrates a portion of the actuator of FIG. 1 in exploded view with certain hardware removed, showing a linkage to a control arm.

FIG. 2 illustrates an embodiment of a portion of the actuator of FIG. 1 in exploded view with certain hardware removed, showing a linkage to a control arm 220. Mounting hardware is removed. Shown are two coil subassemblies, each having a substantially flat facing side, and each having a frame, 201 and 202. Conducting pathways 203-205, indicated on the top coil subassembly, are configured or wired for three-phase operation and are similar to the conducting pathways in the bottom coil subassembly (not numbered). Shading does not indicate instantaneous electromagnetic polarity or current. Rather, shadings of 203-205 indicate how the conducting pathways are arranged when configured for multiphase operation. The slider of FIG. 2, 206 has a plurality of drive magnets, exemplified by 207 and 208, polarized along a vertical direction, and arranged with alternately opposing pole faces, wherein the pole faces face the conducting pathways on the coil subassemblies. In this illustration, the magnetic holder assembly comprises stationary magnets, exemplified by 210-213, similar to those masked by other hardware on the actuator, and a magnet on the edge of the slider 209, which may be either attracted or repelled by the stationary magnets. Motion of the slider may be facilitated by a bearing assembly 216.

Figure 3:
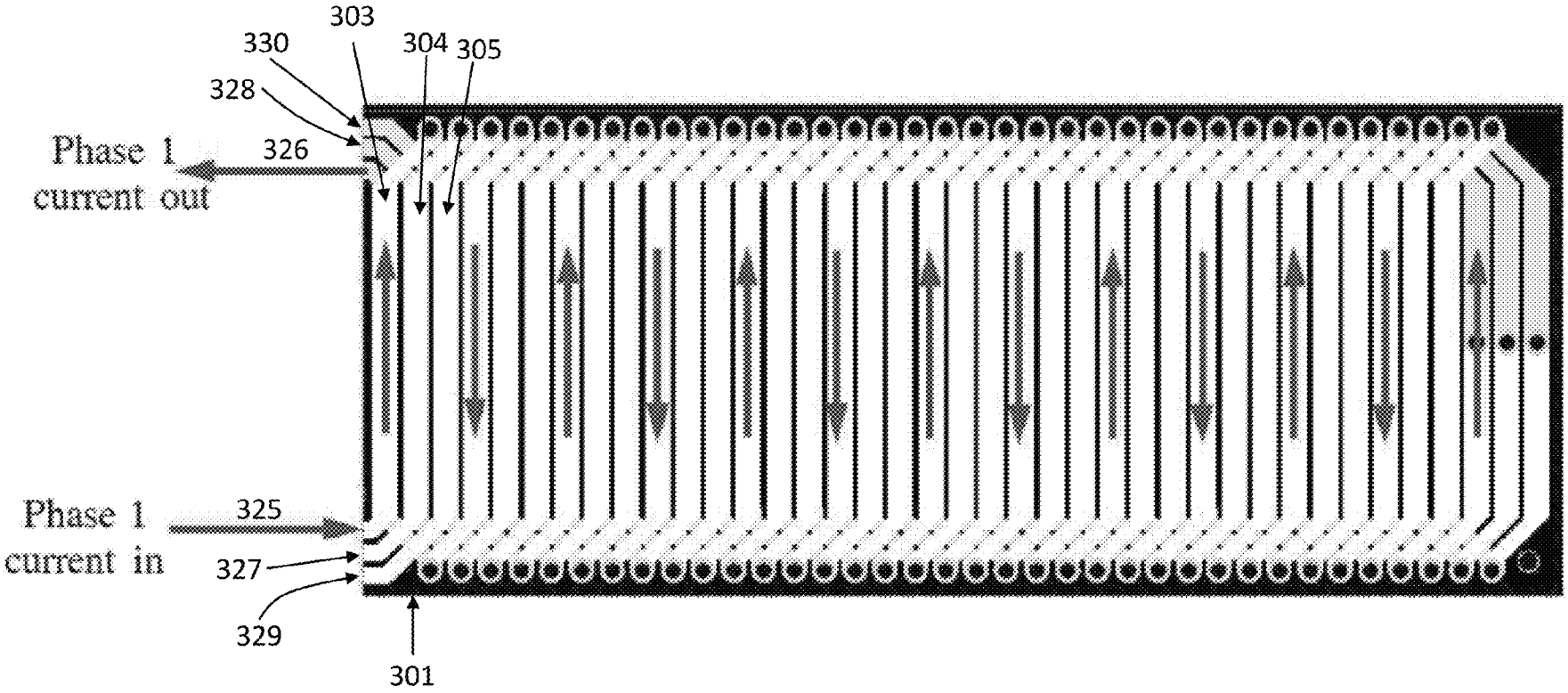
FIG. 3 illustrates a portion of a coil subassembly.

FIG. 3 illustrates an embodiment of a portion of a coil subassembly 301 configured or wired for three phase operation. The coil comprises three serpentine patterns, electrically isolated from one another. In this embodiment, an alternating current (AC) signal having a first phase flows in a first conducting pathway 303 between contact 325 and 326. The arrows superimposed on the conducting pathway between those two points show the relative direction of the current in each segment. In a similar manner, an AC having a second phase flows in a second conducting pathway 304 between contacts 327 and 328. Finally, an AC having a third phase flows in a third conducting pathway 305 between contacts 329 and 330.

Figure 4:
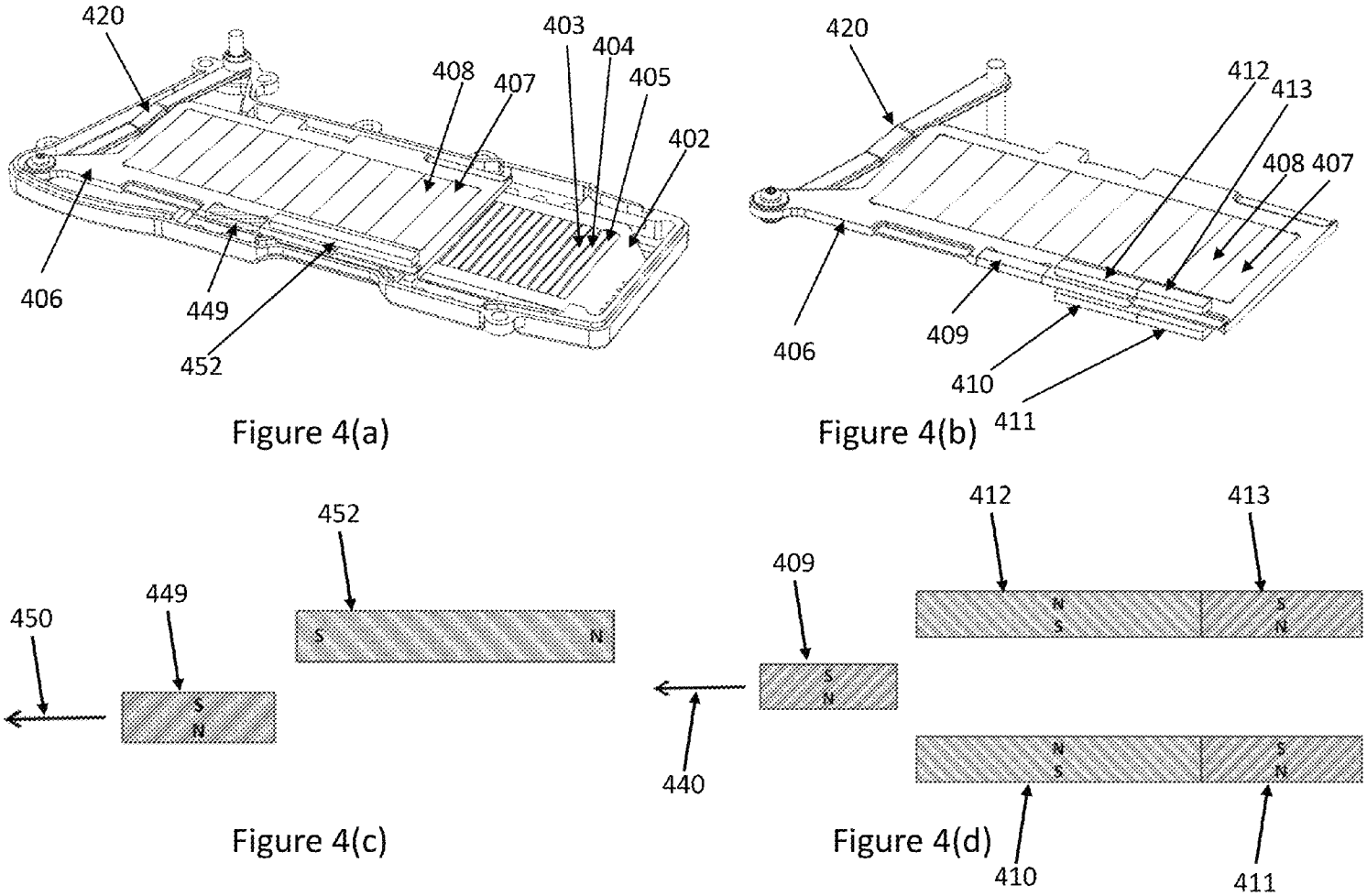
FIG. 4 shows an embodiment of an actuator with various cutaway views.

FIGS. 4(*a*) and (*b*) each illustrate an embodiment of a slider, as in FIGS. 1 and 2 with mounting hardware and coil assemblies partially removed to show exemplary configurations of the magnetic holder. The frame for the coil, 402, supports a plurality of conducting pathways, exemplified by 403-405. The slider, 406 has a plurality of drive magnets, exemplified by 407 and 408. In these embodiments, the magnetic holder assemblies comprise stationary magnet(s), exemplified by 452 in FIG. 4(*a*) and by 410-413 in FIG. 4(*b*), and a magnet 449 on the edge of the slider in FIG. 4(*a*) and 409 in FIG. 4(*b*), each of which may be either attracted or repelled by the stationary magnet(s). Similar magnetic holders may be configured on both sides of the slider to balance forces that may arise perpendicular to the direction of motion. FIG. 4(*c*) shows an example of a holder magnet arrangement with holder magnets 449 and 452 arranged as shown. The magnet 449, mounted on the slider which is positioned in the left-most slider position is repelled as shown in net force vector 450 by the stationary magnet 452, mounted on or near the frames of the coil assemblies. The slider is shown in its left-most stable position wherein a force, represented by net force vector 450, is applied to the actuator linkage arm 420 (shown in FIGS. 4(*a*) and (*b*)). FIG. 4(*d*) shows an example of a holder magnet arrangement with holder magnets 409-413 arranged as shown. The magnet 409 mounted on the slider, positioned in the left-most slider position is repelled as shown in net force vector 440 by the stationary magnets 410-413, mounted on or near the frames of the coil assemblies. The slider is shown in its left-most stable position wherein a force, represented by net force vector 440, is applied to the actuator linkage arm 420 (shown in FIGS. 4(*a*) and (*b*)).

Figures 5, 5A, 5B, 5C, 5D:
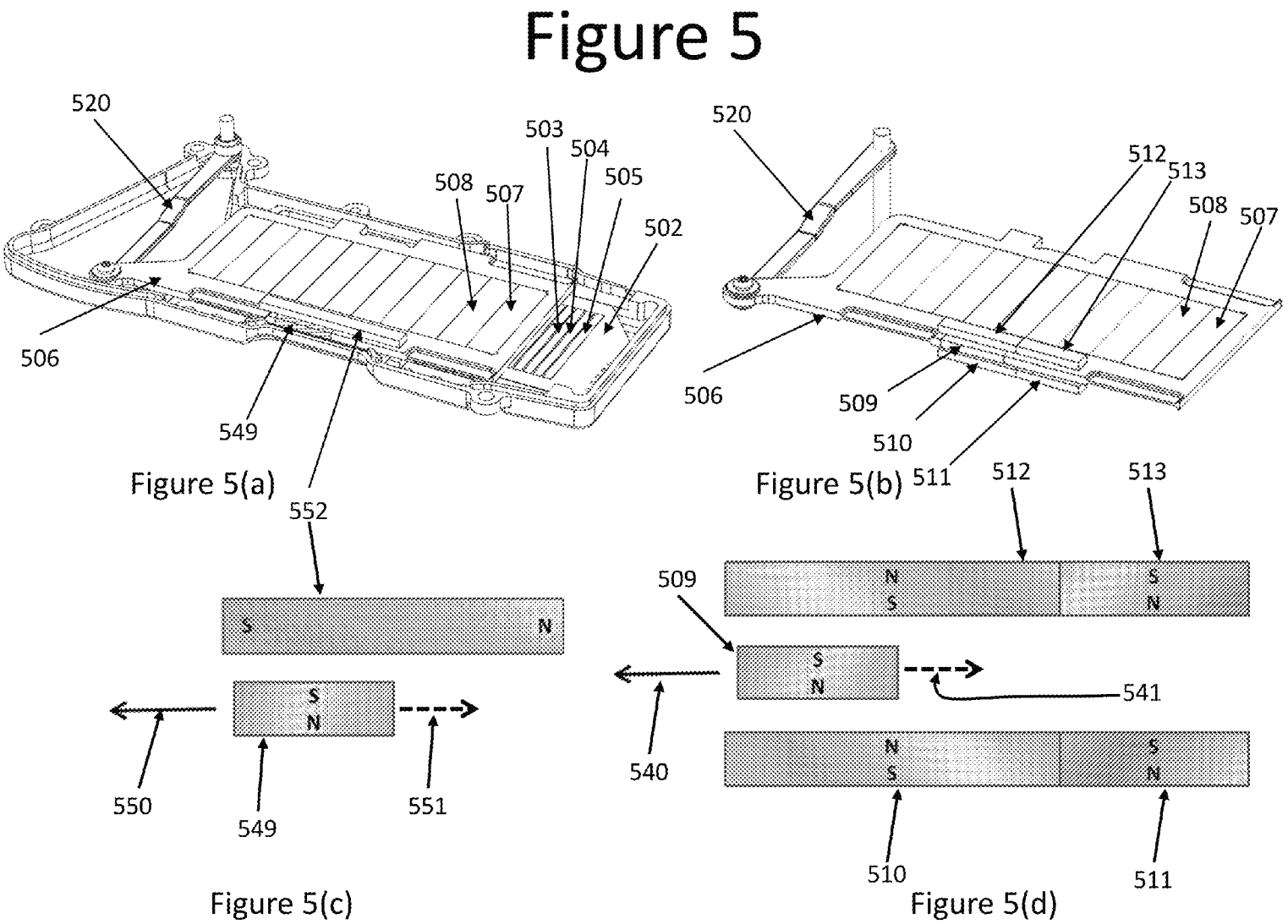
FIG. 5 shows an embodiment of an actuator with various cutaway views.

FIGS. 5(*a*) and (*b*) each illustrate an embodiment of a slider, as in FIGS. 1 and 2 with mounting hardware and coil assemblies partially removed to show exemplary configurations of the magnetic holder. The frame for the coil, 502, supports a plurality of conducting pathways, exemplified by 503-505. The slider, 506, shown in its intermediate position, has a plurality of drive magnets, exemplified by 507 and 508. In this illustration, embodiments of the magnetic holder assemblies comprise stationary magnet(s), exemplified by 552 in FIG. 5(*a*) and 510-513 in FIG. 5(*b*), and a magnet 549 in FIG. 5(*a*) and 509 in FIG. 5(*b*) on the edge of the slider, each of which may be either attracted or repelled by the stationary magnet(s). Similar magnetic holders may be configured on both sides of the slider to balance forces on the slider that may arise perpendicular to the direction of motion. FIG. 5(*c*) provides an example of a holder magnet arrangement with holder magnets 549 and 552 arranged as shown. The magnet 549 mounted on the slider, is positioned in an intermediate position, which position may be unstable, wherein a force, represented by net force vector 550, or by net force vector 551, depending transitionally on its position, is applied to the actuator linkage arm 520 by interacting with the stationary magnet 552, mounted on or near the frames of the coil assemblies. FIG. 5(*d*) shows an example of a holder magnet arrangement with holder magnets 509-513 arranged as shown. The magnet 509 mounted on the slider, is positioned in an intermediate position, which position may be unstable, wherein a force, represented by net force vector 540, or, by net force vector 541, depending transitionally on its position, is applied to the actuator linkage arm 520 by interacting with the stationary magnets 510-513, mounted on or near the frames of the coil assemblies. The slider is shown in an intermediate position wherein a force, represented by net force vector 540 or 541, is applied to the actuator linkage arm 520 (shown in FIGS. 5(*a*) and (*b*)).

Figures 6, 6A, 6B, 6C, 6D:
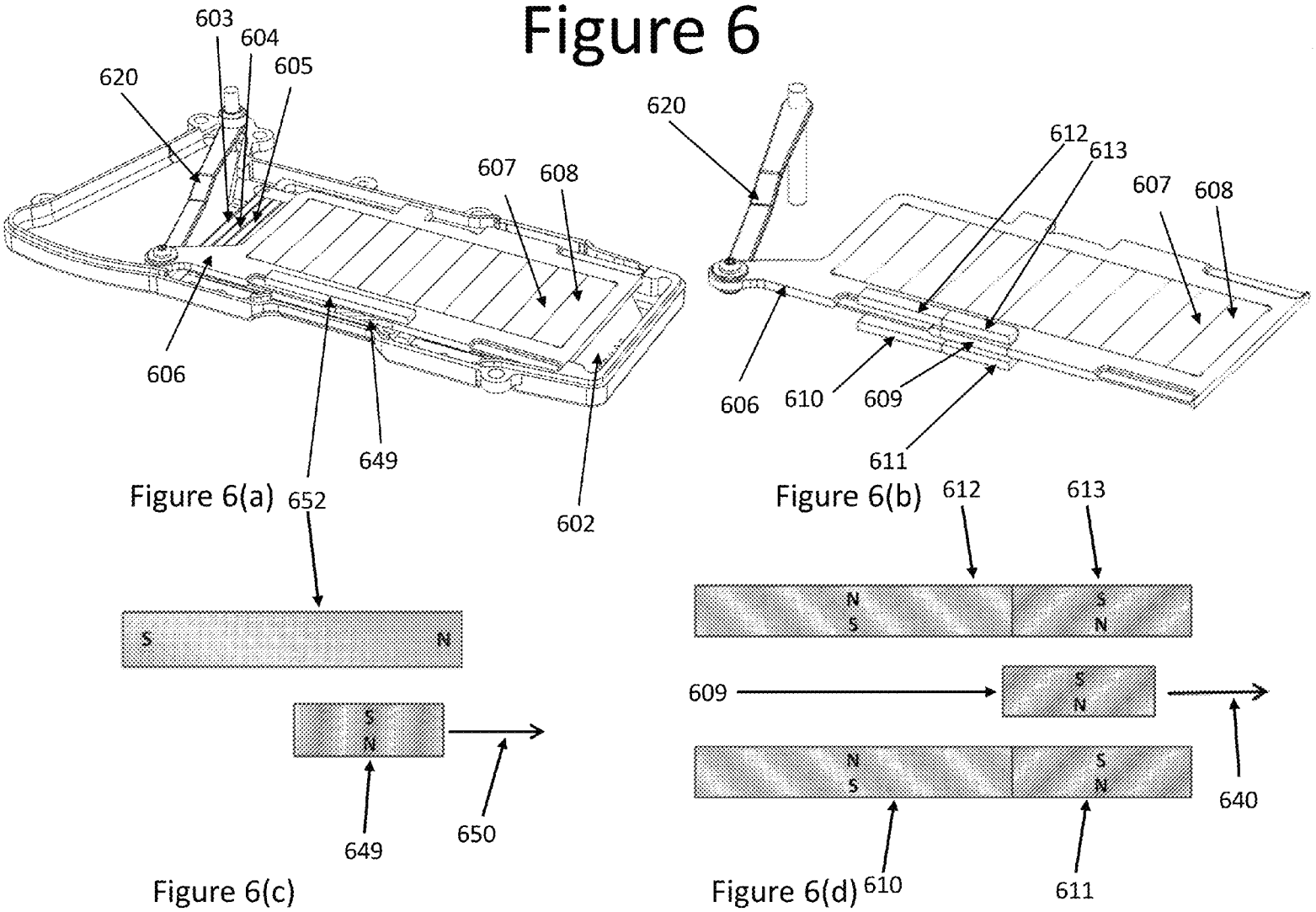
FIG. 6 shows an embodiment of an actuator with various cutaway views.

FIGS. 6(*a*) and (*b*) each illustrate an embodiment of a slider, as in FIGS. 1 and 2 with mounting hardware and coil assemblies partially removed to show exemplary configurations of the magnetic holder. The frame for the coil, 602, supports a plurality of conducting pathways, exemplified by 603-605. The slider, 606 has a plurality of drive magnets, exemplified by 607 and 608. In this illustration, embodiments of the magnetic holder assemblies comprise stationary magnet(s), exemplified by 652 in FIG. 6(*a*) and 610-613 in FIG. 6(*b*), and a magnet 649 on the edge of the slider in FIG. 6(*a*) and 609 in FIG. 6(*b*), each of which may be either attracted or repelled by the stationary magnet(s). Similar magnetic holders may be configured on both sides of the slider to balance forces on the slider that may arise perpendicular to the direction of motion. FIG. 6(*c*) shows an example of a holder magnet arrangement with holder magnets 649 and 652 arranged as shown. The magnet 649 mounted on the slider, positioned in the right-most slider position is repelled as shown in net force vector 650 by the stationary magnet 652, mounted on or near the frames of the coil assemblies. The slider is shown in its right-most stable position wherein a force, represented by net force vector 650, is applied to the actuator linkage arm 620 (shown in FIGS. 6(*a*) and (*b*)). FIG. 6(*d*) shows an example of a holder magnet arrangement with holder magnets 609-613 arranged as shown. The magnet 609 mounted on the slider, positioned in the right-most slider position is repelled as shown in net force vector 640 by the stationary magnets 610-613, mounted on or near the frames of the coil assemblies. The slider is shown in its right-most stable position wherein a force, represented by net force vector 640, is applied to the actuator linkage arm 620 (shown in FIGS. 6(*a*) and (*b*)).

Figure 7:
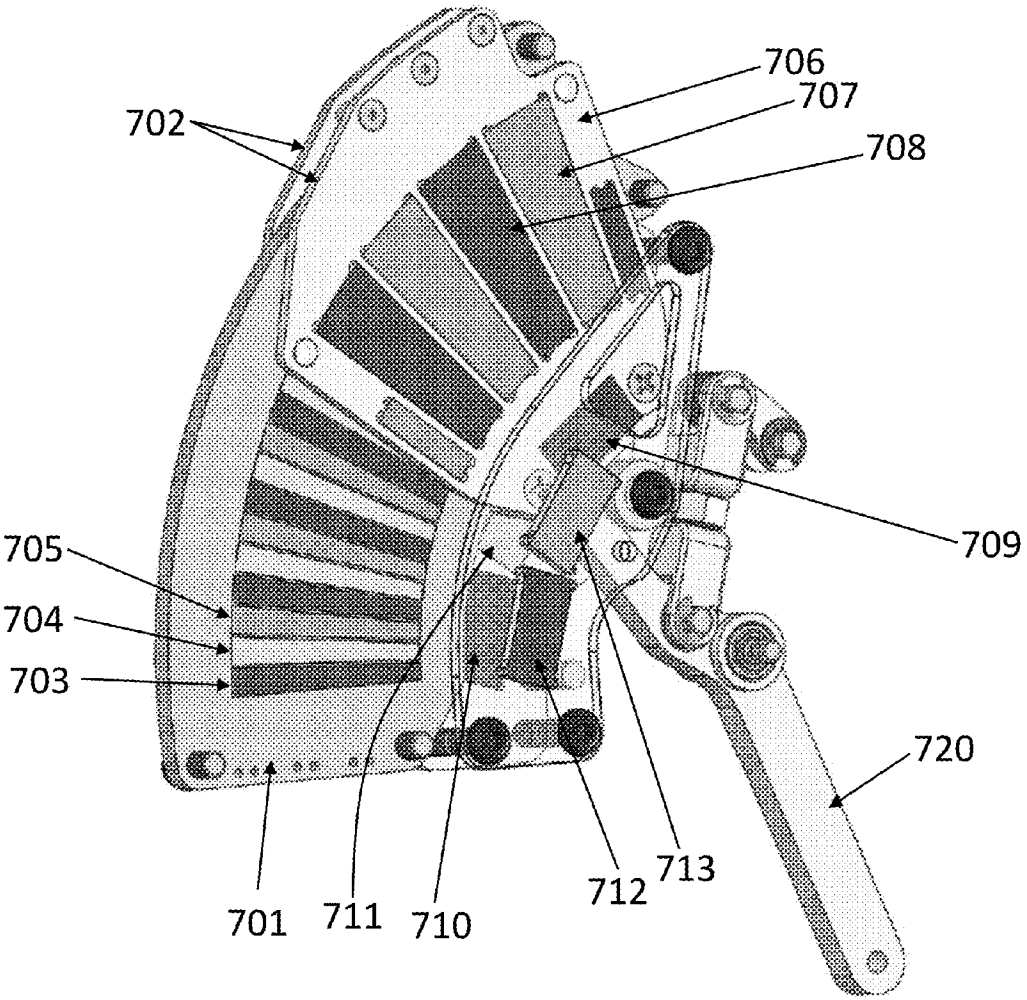
FIG. 7 illustrates another example of an actuator with the slider configured to pivot on an axis. The slider is shown in its right-most stable position.

FIG. 7 illustrates another embodiment of an actuator with the slider configured to pivot on an axis. The slider 706 is shown in its right-most stable position. In this embodiment, the coil may present two flat faces back to back on the same frame, 701. Conducting pathways, exemplified by 703-705, indicated on one side of the coil subassembly, are configured or wired for three-phase operation and are similar to the conducting pathways which may comprise the face the opposite side of the coil subassembly (not shown). Shading does not indicate instantaneous electromagnetic polarity or current. Rather, shadings of 703-705 indicate how the conducting pathways are arranged when configured for multiphase operation. The slider of FIG. 7, 706 may have a "sandwich" structure 702, wherein each layer has a plurality of drive magnets, exemplified by 707 and 708, polarized in a direction normal to the side shown, and arranged with alternately opposite pole faces, wherein the pole faces face the conducting pathways on the coil subassembly. The magnetic holder assembly comprises stationary magnets, exemplified by 710-713, and a magnet on each face of the slider, if applicable, 709, which may be either attracted or repelled by the stationary magnets. The slider is shown in its right-most stable position wherein a force is applied to the actuator linkage arm 720.

Figure 8:
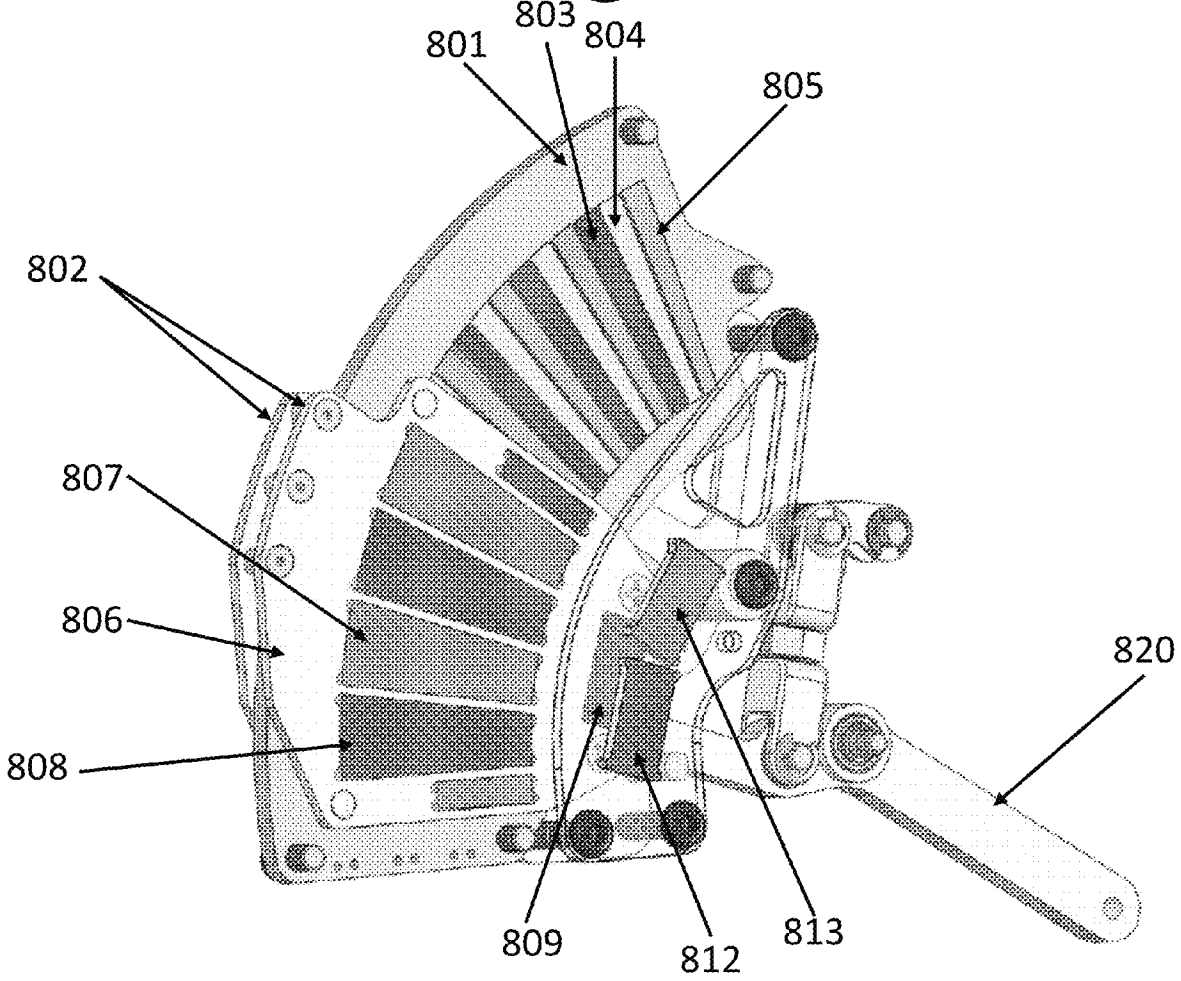
FIG. 8 illustrates another example of an actuator with the slider configured to pivot on an axis. The slider is shown in its left-most stable position.

FIG. 8 illustrates another view of the actuator of FIG. 7 with the slider configured to pivot on an axis. The slider 806 is shown in its left-most stable position. In this embodiment, the coil may present two flat faces back to back on the same frame, 801. Conducting pathways 803-805, indicated on one side of the coil subassembly, are configured or wired for three-phase operation and are similar to the conducting pathways which may comprise the face the opposite side of the coil subassembly (not shown). Shading does not indicate instantaneous electromagnetic polarity or current. Rather, shadings of 803-805 indicate how the conducting pathways are arranged when configured for multiphase operation. The slider of FIG. 8, 806 may have a "sandwich" structure 802, wherein each layer has a plurality of drive magnets, exemplified by 807 and 808, polarized in a direction normal to the side shown, and arranged with alternately opposite pole faces, wherein the pole faces face the conducting pathways on the coil subassembly. The magnetic holder assembly comprises stationary magnets, exemplified by 812-813, and a magnet on each face of the slider, if applicable, 809, which may be either attracted or repelled by the stationary magnets. Not shown are the stationary magnets 810-811 shown as 710-711 in FIG. 7 because they are obscured by the position of the slider. The slider is shown in its left-most stable position wherein a force is applied to the actuator linkage arm 820.

Figure 9:
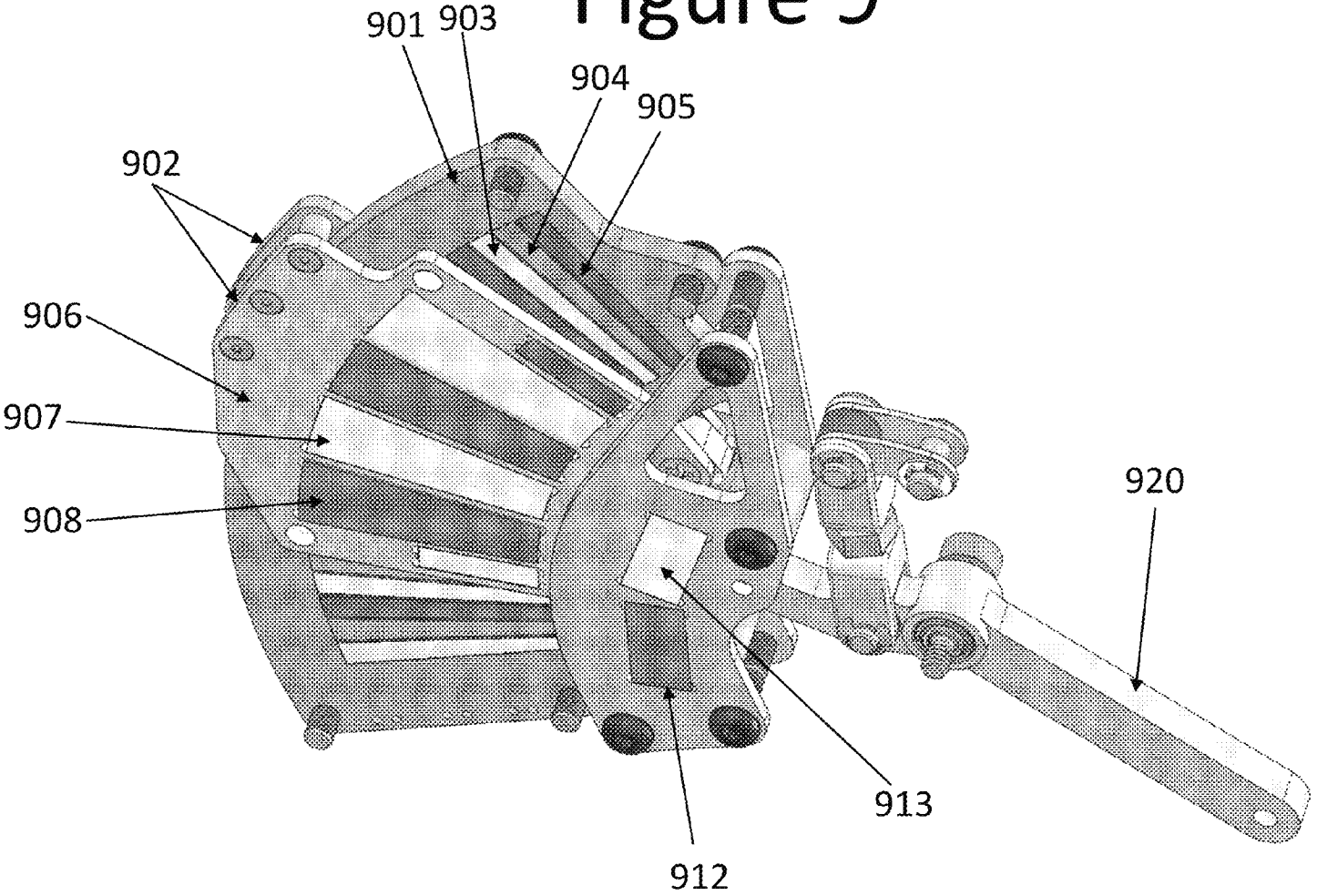
FIG. 9 illustrates another example of an actuator with the slider configured to pivot on an axis. The slider is shown in its midrange position.

FIG. 9 illustrates another view of the actuator of FIGS. 7-8 with the slider configured to pivot on an axis. The slider 906 is shown in an intermediate position. In this embodiment, the coil may present two flat faces back to back on the same frame, 901. Conducting pathways 903-905, indicated on one side of the coil subassembly, are configured or wired for three-phase operation and are similar to the conducting pathways which may comprise the face the opposite side of the coil subassembly (not shown). Shading does not indicate instantaneous electromagnetic polarity or current. Rather, shadings of 903-905 indicate how the conducting pathways are arranged when configured for multiphase operation. The slider of FIG. 9, 906 may have a "sandwich" structure 902, wherein each layer has a plurality of drive magnets, exemplified by 907 and 908, polarized in a direction normal to the side shown, and arranged with alternately opposite pole faces, wherein the pole faces face the conducting pathways on the coil subassembly. The magnetic holder assembly comprises stationary magnets, exemplified by 912-913, and a magnet on each face of the slider, if applicable (shown in FIG. 8 as 809, obscured in this view), which may be either attracted or repelled by the stationary magnets. Not shown are the stationary magnets 910-911, shown as 710-711 in FIG. 7 and the magnet on the slider 909, shown as 809 in FIG. 8 because they are obscured by the position of the slider. The slider is shown in an intermediate position wherein a force is applied to the actuator linkage arm 920. Depending on the intermediate position of magnet 909, the force applied to the linkage arm may be in either direction, as shown by analogy with FIG. 10, infra.

Figure 10:
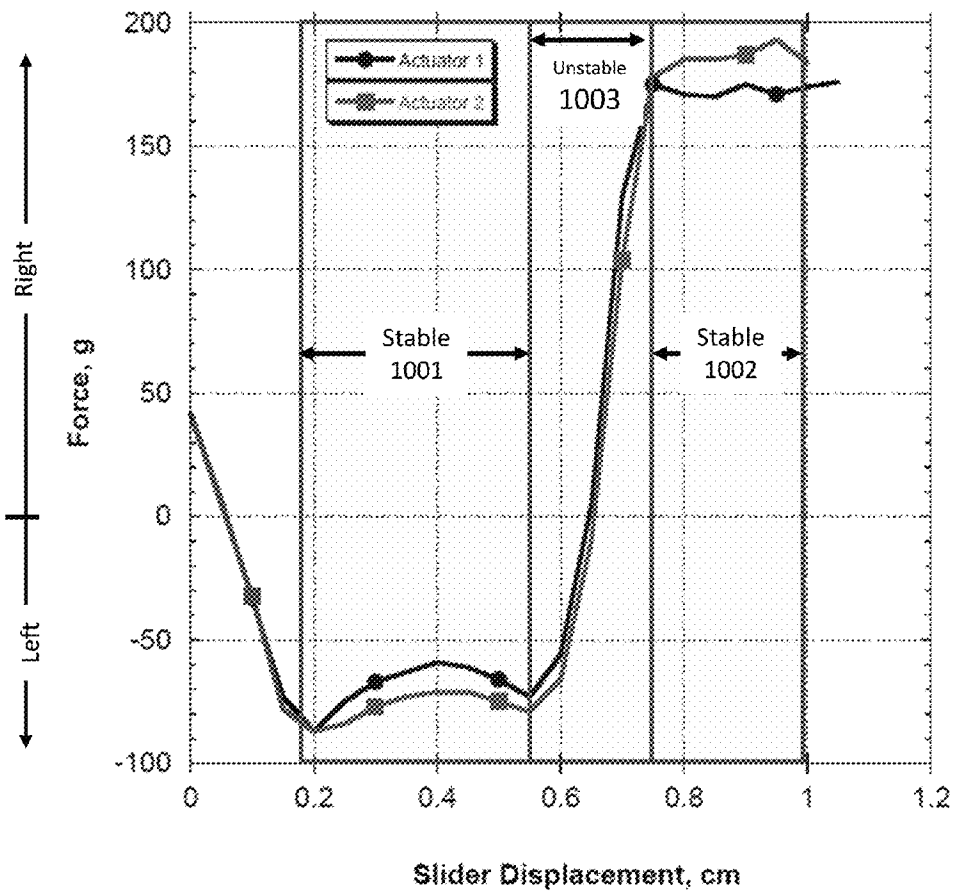
FIG. 10 illustrates results of static force tests of the actuator shown in FIG. 1. The graphs show force as a function of slider displacement, wherein the forces are exerted by the magnets on the holder.

FIG. 10 illustrates results of static force tests of the actuator shown in FIG. 1. The graphs show gram equivalent force as a function of slider displacement in cm, wherein the forces are a function of displacement and are exerted by interactions among the stationary magnets and the magnet mounted on the slider as shown in FIGS. 4(*b*) and 4(*d*). When the slider is in its left-most position, a force to the left 1001 is imposed. When the slider is in its right-most position, a force to the right 1002 is imposed. When in use, the magnetic force holding assembly maintains the slider in substantial repulsion at the left position and substantial attraction at the right position. When the slider is in an intermediate position, the force 1003 depends transitionally on the position.

Figure 11:
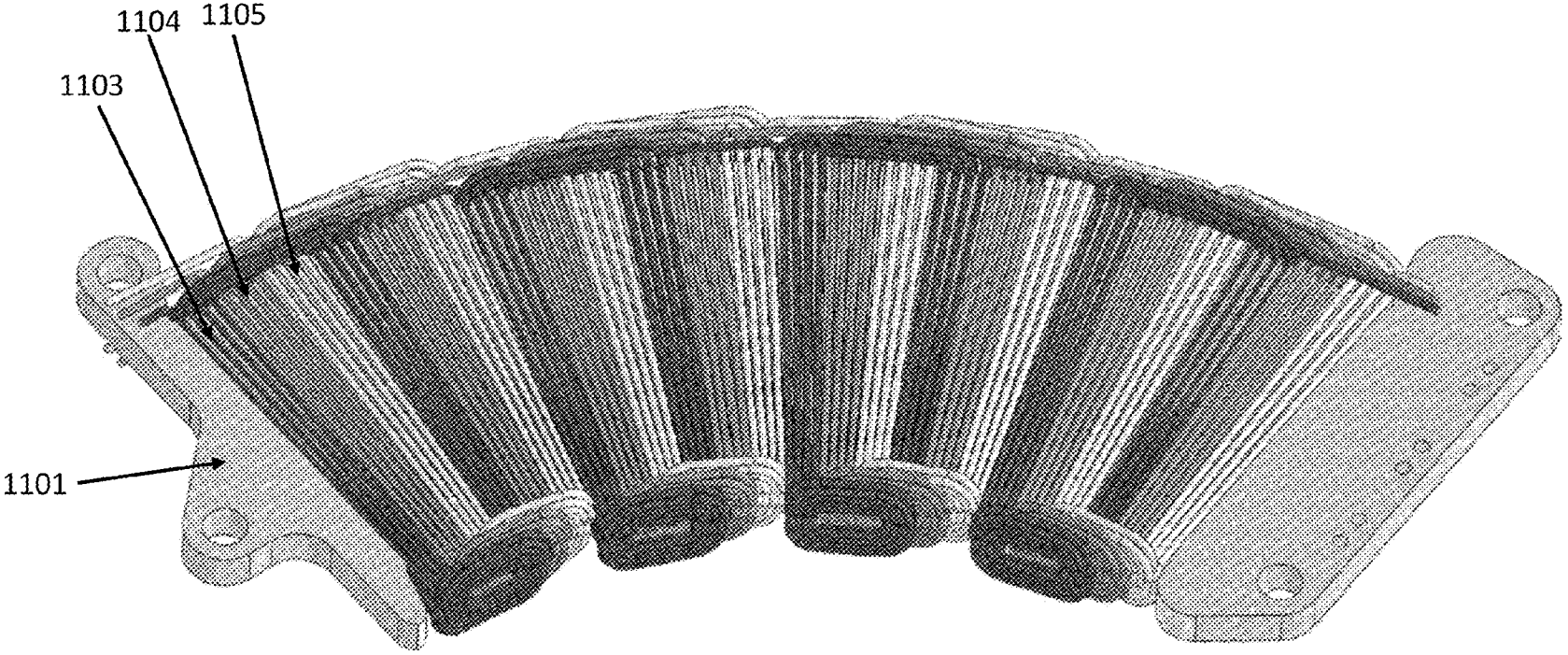
FIG. 11 illustrates a portion of a coil subassembly wherein the conducting pathways form an essentially flat facing side and can be wired for three-phase operation.

FIG. 11 illustrates another embodiment a portion of a coil subassembly wherein the conducting pathways form an essentially flat facing side and can be wired for three-phase operation. In this figure, the conducting pathways comprise wire wrappings, exemplified by 1103-1105, wrapped on a frame 1101 to form an essentially flat facing side.

DETAILED DESCRIPTION

As used herein, the conjunction "and" is intended to be inclusive and the conjunction "or" is not intended to be exclusive unless otherwise indicated. For example, the phrase "or, alternatively" is intended to be exclusive. As used herein, the descriptor "exemplary" is understood as a pointer to an example and is not intended to indicate preference. As used herein, the term "essentially flat" is intended to describe a roughly planar facing which may or may not exhibit topography. For example, an essentially flat facing side may be seen in FIG. 11 and may be distinguished from a coil formed on a curved substrate. As used herein, the terms "holder" and "magnetic force holding assembly" are understood to be interchangeable.

Disclosed herein is an actuator, comprising: (a) a frame; (b) a slider, wherein the slider is displaceable over a range of travel between a first position and a second position; and (c) a magnetic force holding assembly, comprising: (i) at least one permanent magnet on the slider; and; (ii) at least one permanent magnet on the frame proximally positioned to the permanent magnet on the slider; wherein, when in use, the magnetic force holding assembly maintains the slider in substantial repulsion at the first position and substantial attraction at the second position.

The actuator may further comprise an actuation mechanism, powered by an electrical power source, said actuation mechanism comprising: (a) one or more coil subassemblies, affixed to the frame, wherein each coil subassembly is configured for multiphase operation, and wherein each coil subassembly comprises: a plurality of conducting pathways, comprising a conductor, wherein the conducting pathways are mounted at least partially on the facing side of the coil subassembly, and wherein each conducting pathway is electrically isolated from the others; and (b) a slider comprising: (i) a frame; and (ii) two or more drive magnets attached to the frame, wherein each of the drive magnets is arrayed so that its nearest neighbor(s) have opposing magnetic polarity.

Further disclosed herein is an actuator, comprising: (a) one or more coil subassemblies, each coil subassembly having a substantially flat facing side, wherein each coil subassembly is configured for multiphase operation, and wherein each coil subassembly comprises: a substrate; and a plurality of conducting pathways, each comprising a conductor, wherein the conducting pathways are mounted at least partially on the facing side of the coil subassembly, and wherein each conducting pathway is electrically isolated from the others; (b) a slider comprising: (i) a frame; M drive magnets attached to the frame, wherein each of the drive magnets is arrayed so that its nearest neighbor(s) have opposing magnetic polarity, and wherein M is an integer from 2 to 20; and (c) at least one magnetic holder, for holding the slider in one of two opposing states without expending additional energy from the electrical power source; wherein the actuator is powered by an electrical power source, when in use.

The magnetic holder of the further disclosed embodiment, supra, may also comprise (i) at least one permanent magnet on the slider; and; (ii) at least one permanent magnet on the frame proximally positioned to the at least one permanent magnet on the slider; wherein, when in use, the magnetic holder maintains the slider in substantial repulsion at the first opposing state and substantial attraction at the second opposing state without drawing power from the electrical power source.

In addition to the above embodiments, further embodiments may also include features that facilitate design and operation. For example, displacement limiters or stops may be used to prevent the slider from moving out of its operating range. Displacement limiters may comprise mechanical stops such as cushioned or hard posts, springs, narrowed channels in which increased friction may arise, hydraulic or pneumatic devices as well as magnetic stops, electromagnetic stops, ferroelectric or electrostrictive stops, friction braking devices and the like.

In addition, modifications such as guide structures, bearings and bushings may be used to facilitate movement of the slider and reduce friction and noise. Bearing assemblies may be built into the coil body and slider by way of slots or the like. Lubricants like oils, greases, graphite combinations of oils and water, polymers such as poly tetrafluoroethylene and polymerized ethylenically unsaturated fluoroethers, alone or in combination with protic or non-protic lubricants may also be used. In addition, non contact devices may be used. These include, without limitation, magnetic guides, electrostatic guides and the like.

Electrical power sources may be used to provide the necessary power to the actuator and may comprise rechargeable and non rechargeable batteries, capacitors, supercapacitors, inductive devices, RF devices, external generators, AC current and the like.

Coils may comprise conductors, semiconductors and superconductors. Conductors may include, without limitation, metals such as copper, silver, gold, platinum, palladium aluminum or other metal. In situations where cooling is available and low power dissipation is desired, superconducting materials may be used. Exemplary superconducting materials may include, without limitation, $YBa_2Cu_3O_7$, $Bi_2Sr_2CuO_6$, $Bi_2Sr_2CaCu_2O_8$, $Tl_2Ba_2CuO_6$, $HgBa_2Ca_2Cu_3O_8$, $Tl_2Ba_2CaCu_2O_8$, $Tl_2Ba_2Ca_2Cu_3O_{10}$, $TlBa_2Ca_3Cu_4O_{11}$, $HgBa_2CuO_4$, $HgBa_2CaCu_2O_6$, $HgBa_2Ca_2Cu_3O_8$. The coil may be in the form of wires of cylindrical or ribbon shape. Exemplary wire cross sectional dimensions (diameters, rectangular lengths, etc.) may be from about 0.05 mm to about 5 mm. Further exemplary wire cross sections may be from about 0.1 mm to about 1 mm. Further, the coil, may comprise wires wrapped in manner hereinabove described or may comprise printed features on a substrate. Printed wiring features may have exemplary thicknesses of from about 0.001 mm to about 5 mm. Further exemplary thicknesses may be from 0.01 mm to 2 mm. Exemplary widths may from about 0.001 mm to about 5 mm. Further exemplary widths may be from 0.01 mm to 3 mm. The conducting pathways printed on a substrate may be arranged in a serpentine pattern with the conducting pathways interdigitated with one another. The topography on the coil assembly may comprise thickness variations due to placement of the conductive pathways and is not intended to detract from the coil assembly being "essentially flat" in the portion proximal to the drive magnets.

When wired for N-phase operation, N conducting pathways, isolated from one another as in FIGS. 3 and 11. Shown in those Figures are coil assemblies that are wired for three-phase operation because there are three isolated conducting pathways in each. In addition, a preferred configuration is one in which the drive magnet array is cast on approximately the same pitch as the arrangement of the coils on the coil assembly. In one embodiment, a slider having an even number of drive magnets faces a single side (or facing region) of a coil assembly. In another embodiment, a slider having an even number of drive magnets with both poles available for interaction, faces two coils, one on each side as in FIG. 1. In still another embodiment, the slider with an even number of drive magnets may sandwich a coil such that two sliders coupled together move past a two-sided coil as shown in FIGS. 7-9. In still another embodiment, the slider with an odd number of drive magnets may sandwich a coil such that two sliders coupled together move past a two-sided coil.

Multiphase signals to the coils may be supplied by known methods. In one embodiment, the phased current is provided to the coils by a multichannel pulse-width modulator, such as might be available, for example, as the MSP430F1232, F1222, F1132 or F1122, integrated circuit devices available from Texas Instruments. In another embodiment, a multiphase signal may be generated according to the method set forth by Dooghabadi, et al. "Multiphase Signal Generation Using Capacitive Coupling of LC-VCOs," Electronics, Circuits and Systems, 2007. ICECS 2007. 14th IEEE International Conference on, vol., no., pp. 1087, 1090, 11-14 Dec. 2007.

Conducting pathways using wires or features printed on circuit boards may be used for coils wired for multiphase operation. Wires may be isolated from each other by using a suitable insulation material such as polyethylene, polypropylene, polyvinyl chloride, polytetrafluoroethylene or other insulating polymer. In addition wires may be coated with insulating materials such as varnishes, lacquers, or shellacs. Conducting pathways formed on printed circuit boards, such as depicted in FIG. 3, may be electrically isolated according to known methods of making multi-layer printed circuit boards. Multi-layer printed circuit boards have trace layers inside the board, achieved by laminating a stack of boards with circuits etched on them in a press and applying pressure and heat. For example, a four-layer PCB can be fabricated starting from a two-sided copper-clad laminate, etching the circuitry on one or both sides, and laminating the top and bottom layers to one another. The resulting workpiece may then be drilled, plated, and etched again to get traces on top and bottom layers.

Further embodiments of the actuators described herein include magnetic position sensors to allow monitoring of the position of the slider. Such monitoring may be used for error correction, determination of the state of the actuator, and/or mechanical switching rate, as well as closed-loop operation and field control. Magnetic position sensors may be on a linear or rotary scale. Moreover, the resolution of the position sensor may be determined by the number of bits in the digital signal. Sensors are available in 8-16 bit resolutions. Such devices may be obtained from AMS Corporation of Raleigh, N.C.

Suitable permanent magnets for the embodiments of this disclosure may include, without limitation, rare earth magnets such as samarium-cobalt and neodymium-iron-boron, specific examples of which include $Nd_2Fe_{14}B$ (sintered), $Nd_2Fe_{14}B$ (bonded), $SmCo_5$ (sintered), $Sm(Co,Fe,Cu,Zr)_7$ (sintered), Sr-ferrite (sintered), which generate high field strengths per unit volume. Weaker magnets such as Alnico or ceramic may also be utilized. Bar magnets may be polarized along the thin dimension so that, for example, the top comprises the north pole and the bottom comprises the south pole such as, for example 409 in FIG. 4(*d*). Bar magnets may be polarized along the thick dimension so that, for example, one side comprises the north pole and the opposite side comprises the south pole, such as in 552 in FIG. 5(*c*). In systems wired for multiphase operation, the drive magnet array may be formed from a plurality of magnets which are conveniently though not necessarily attached to the slider. In particular, M drive magnets attached to the slider, wherein each of the drive magnets is arrayed so that its nearest neighbor(s) have opposing magnetic polarity, and wherein, for example, M is an integer from 2 to 20. As a further example, M can be from 2 to 10. A preferred configuration is one in which M is an even number.

Although the present invention has been shown and described with reference to particular examples, various changes and modifications which are obvious to persons skilled in the art to which the invention pertains are deemed to lie within the spirit, scope and contemplation of the subject matter set forth in the appended claims.

What is claimed is:

1. An actuator, comprising:

a. a frame;

b. a slider, wherein the slider is displaceable over a range of travel between a first position and a second position; and c. a magnetic force holding assembly, comprising:

i. at least one permanent magnet on the slider; and;

ii. at least one permanent magnet on the frame proximally positioned to the permanent magnet on the slider;

wherein, when in use, the magnetic holding assembly holds the slider in position with substantial repulsion in the first position and substantial attraction in the second position without drawing power from any electrical power source.

2. The actuator of claim 1, further comprising a first displacement limiter and a second displacement limiter.

3. The actuator of claim 2 wherein first displacement limiter and the second displacement limiter comprise stops.

4. The actuator of claim 2 wherein the frame has a guide for displacement of the slider.

5. The actuator of claim 1, further comprising an actuation mechanism, powered by an electrical power source, said actuation mechanism comprising:

a. one or two coil subassemblies, affixed to the frame, wherein each coil subassembly is configured for multiphase operation, and wherein each coil subassembly comprises: a plurality of conducting pathways, comprising a conductor, wherein the conducting pathways are mounted at least partially on the facing side of the coil subassembly, and wherein each conducting pathway is electrically isolated from the others; and b. the slider comprising:

i. a frame; and ii. two or more drive magnets attached to the frame, wherein each of the drive magnets is arrayed so that its nearest neighbor(s) have opposing magnetic polarity.

6. The actuator of claim 5, wherein the each coil subassembly has a substantially flat facing side.

7. An actuator, comprising:

a. one or two coil subassemblies, each coil subassembly having a substantially flat facing side, wherein each coil subassembly is configured for multiphase operation, and wherein each coil subassembly comprises:

i. a substrate; and ii. a plurality of conducting pathways, each comprising a conductor, wherein the conducting pathways are mounted at least partially on the facing side of the coil subassembly, and wherein each conducting pathway is electrically isolated from the others;

b. a slider comprising:

i. a frame;

ii. M drive magnets attached to the frame, wherein each of the drive magnets is arrayed so that its nearest neighbor(s) have opposing magnetic polarity, and wherein M is an integer from 2 to 20;

c. at least one magnetic holder, for holding the slider in one of two opposing states without expending additional energy from the electrical power source;

wherein the at least one magnetic holder comprises:

i. at least one permanent magnet on the slider; and;

ii. at least one permanent magnet on the frame proximally positioned to the permanent magnet on the slider;

wherein the actuator is powered by an electrical power source, when in use, and wherein, when in use, the magnetic holder maintains the slider in substantial repulsion at the first opposing state and substantial attraction at the second opposing state.

8. The actuator of claim 7, further comprising one or more position sensors for sensing the position of the slider.

9. The actuator of claim 7, wherein the facing side of at least one coil assembly comprises N interdigitated conducting pathways, each having a generally regular serpentine structure, and wherein N is 2-10.

10. The actuator of claim 9, wherein the generally regular serpentine structure of the conducting pathways is cast on a linear pitch and the drive magnets are arrayed to be cast on substantially the same linear pitch as that of the generally regular serpentine structure of the conducting pathways.

11. The actuator of claim 9, wherein the generally regular serpentine structure of the conducting pathways is cast on an angular pitch and the drive magnets are arrayed to be cast on substantially the same angular pitch as that of the generally regular serpentine structure of the conducting pathways.

12. The actuator of claim 7, further comprising a guide for maintaining the alignment of the slider.

13. The actuator of claim 9, further comprising a linkage, for coupling the motion of the slider to the device to be actuated.

14. The actuator of claim 7, further comprising a linkage.

15. The actuator of claim 7, wherein the conductor is chosen from a metal, an alloy, or a compound conductor comprising one or more of the elements, copper, silver, gold, platinum, palladium or aluminum.

16. The actuator of claim 7, wherein the conducting pathways of at least one coil subassembly comprise N wrapped wires, wherein the N wrapped wires are at least partially laid out on an alternating configuration on the facing side of the coil subassembly, and wherein N is 2-10.

17. The actuator of claim 16, wherein the N wrapped wires on the facing side of the coil subassembly are cast on a linear pitch and the drive magnets on the slider are arrayed to be cast on substantially the same linear pitch as that of the N wrapped wires on the facing side of the coil subassembly.

18. The actuator of claim 16, wherein the N wrapped wires on the facing side of the coil subassembly are cast on an angular pitch and the drive magnets on the slider are arrayed to be cast on substantially the same angular pitch as that of the N wrapped wires on the facing side of the coil subassembly.

19. The actuator of claim 9, functionally connected to a drive circuit for providing a phased current to each of the N interdigitated conducting pathways.

20. The actuator of claim 19, wherein the drive circuit is a multichannel pulse-width modulator.

21. The actuator of claim 19, further comprising one or more position sensors for sensing the position of the slider, wherein the position sensors are functionally connected to the drive circuit.

22. The actuator of claim 7, further comprising one or more mechanical, magnetic or electrostatic stops for limiting the range of motion of the slider.

* * * * *